US009741520B2

(12) United States Patent
Song

(10) Patent No.: US 9,741,520 B2
(45) Date of Patent: Aug. 22, 2017

(54) MOLDED CASE CIRCUIT BREAKER

(71) Applicant: LSIS CO., LTD., Anyang-si, Gyeonggi-do (KR)

(72) Inventor: Suyang Song, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/970,295

(22) Filed: Dec. 15, 2015

(65) Prior Publication Data

US 2016/0217958 A1 Jul. 28, 2016

(30) Foreign Application Priority Data

Jan. 22, 2015 (KR) ..... 10-2015-0010792

(51) Int. Cl.

| | |
|---|---|
| ***H01H 1/52*** | (2006.01) |
| ***H01H 3/20*** | (2006.01) |
| ***H01H 9/00*** | (2006.01) |
| ***H01H 71/10*** | (2006.01) |
| ***H01H 71/50*** | (2006.01) |
| ***H01H 71/52*** | (2006.01) |

(52) U.S. Cl.

CPC ..... *H01H 71/1054* (2013.01); *H01H 71/501* (2013.01); *H01H 71/52* (2013.01); *H01H 71/525* (2013.01); *H01H 2205/002* (2013.01)

(58) Field of Classification Search

CPC .. H01H 1/52; H01H 3/20; H01H 9/00; H01H 71/10; H01H 71/1072; H01H 71/12; H01H 71/128; H01H 71/50; H01H 71/505; H01H 71/525; H01H 71/25; H01H 73/00; H01H 73/22; H01H 73/24; H01H 73/38; H01H 73/50; H01H 71/1054; H01H 71/501; H01H 71/52; H01H 2205/002

USPC ..... 200/322, 50.32, 43.01, 43.05, 43.06, 200/43.08, 43.11, 43.14, 43.15, 43.16, 200/43.19, 43.21, 43.22

See application file for complete search history.

(56) References Cited

U.S. PATENT DOCUMENTS 5,008,504 A * 4/1991 Ozaki ..... H01H 71/525 200/322

FOREIGN PATENT DOCUMENTS

| | | |
|---|---|---|
| DE | 102009007478 | 8/2010 |
| EP | 2204835 | 7/2010 |
| EP | 2597669 | 5/2013 |
| EP | 2634787 | 9/2013 |
| JP | 2003-346631 | 12/2003 |

(Continued)

OTHER PUBLICATIONS

Korean Intellectual Property Office Application Serial No. 10-2015-0010792, Office Action dated Jun. 13, 2016, 5 pages.

(Continued)

*Primary Examiner* — Anthony R. Jimenez

(74) *Attorney, Agent, or Firm* — Lee, Hong, Degerman, Kang & Waimey

(57) ABSTRACT

The present invention relates to a molded case circuit breaker, in which a locking member is formed at an inner side of a lever and an anti-rotation member is formed at an upper like. Accordingly, the locking member can be brought into contact with the anti-rotation member even though a handle is rotated to an OFF position even in a fused state between a fixed contactor and a movable contactor, thereby preventing a rotation of the handle to the OFF position.

1 Claim, 10 Drawing Sheets

(56) References Cited

FOREIGN PATENT DOCUMENTS

KR 20-2012-0004950 7/2012

OTHER PUBLICATIONS

European Patent Office Application Serial No. 15201943.6, Search Report dated Jun. 2, 2016, 8 pages.

* cited by examiner

MOLDED CASE CIRCUIT BREAKER

CROSS-REFERENCE TO RELATED APPLICATION

Pursuant to 35 U.S.C. §119(a), this application claims the benefit of earlier filing date and right of priority to Korean Patent Application No. 10-2015-0010792, filed on Jan. 22, 2015, the contents of which are hereby incorporated by reference herein in its entirety.

BACKGROUND OF THE INVENTION

1. Field of the Invention

This specification relates to a molded case circuit breaker, and more particularly, a molded case circuit breaker, capable of preventing an occurrence of a fault by allowing for recognizing a state of the molded case circuit breaker from the exterior without an error, in a manner of preventing a handle from being moved to an OFF position when a fixed contactor and a movable contactor are fused to each other.

2. Background of the Invention

In general, a molded case circuit breaker (MCCB) is installed in a switchboard among electric power receiving and distribution facilities of factories, buildings and the like, so as to serve as a switching device of supplying power or cutting off power to a load side in a non-load state, and serve as a circuit breaker of supplying power or cutting off power from a power source side to the load side to protect an electric line of an electric circuit and a device of the load when a high current exceeding a load current flows due to an occurrence of a fault on an electric circuit of the load during the use of the load.

FIG. 1 is a schematic sectional view illustrating a configuration of the related art molded case circuit breaker, FIG. 2 is a schematic sectional view illustrating a state when the related art molded case circuit breaker is located at an ON position, and FIG. 3 is a schematic view illustrating a state where a lever is rotated to an OFF position while the related art molded case circuit breaker is in a fused state.

As illustrated in FIGS. 1 to 3, the related art molded case circuit breaker is connected to an upper electric line through a fixed contactor 60, and perform switching of inner lines thereof through a movable contactor 50.

The movable contactor 50 may be locked (restricted) by a shaft 40 and a contact spring 80. The movable contactor 50 comes in contact with or is separated from the fixed contactor 60 while performing a rotational motion centering on the shaft 40.

Also, a position of a lever 10 connected with a handle is decided by rotating the handle in response to a user's manipulation. Directions of weight and force change according to the position of the lever 10. Accordingly, strength of force applied through a main spring 70 connected to the lever 10 may differ.

Here, force generated by an elastic force of the main spring 70 is transferred to the shaft 40 through a lower link 30 such that the shaft 40 can perform a rotational motion. Also, the movable contactor 50 rotatably connected to the shaft 40 also cooperatively rotates, thereby switching on or off the molded case circuit breaker. Here, the lower link 30 is rotatably connected to the shaft 40 by use of a shaft pin 41. In this instance, contact pressure is decided by a contact spring 80.

As illustrated in FIG. 2, an angle between a lower end point 70*a* of the main spring 70 and a rotation point 10*a* of the lever 10 is designed to be about 5° when the molded case circuit breaker is located at an ON position. Under a condition that the movable contactor 50 and the fixed contactor 60 are in a bonded state due to fusion occurred between the movable contactor 50 and the fixed contactor 60, even though the lower end point 70*a* of the main spring 70 is moved toward the rotation point 10*a* of the lever 10 in response to a counterclockwise rotation of a lower end of the lower link 30 by an extra contact angle of the shaft 40, as illustrated in FIG. 3, it is designed that a rotation point of the main spring 70 is located ahead of the rotation point 10*a* of the lever 10.

Therefore, in a state where the lever 10 has been rotated from an ON state into an OFF state due to a weight by the main spring 70 generated only at the front of the rotation point 10*a* of the lever 10, when a manipulation force is removed, the lever 10 is returned to an ON position by the main spring 70 and the molded case circuit breaker displays an ON state. This function is referred to as a main contact location function.

The main contact location function will be described in more detail. For a current-limiting circuit breaker, when a fault current is generated on a load or an electric line, the least operation time called an unlatch time is taken to release a mechanical mechanism.

Upon generation of a fault current, during a shorter time than the least operation time, the movable contactor 50 and the fixed contactor 60 are separated from each other due to an electronic repulsive force between contacts, and accordingly a space is generated between the movable contactor 50 and the fixed contactor 60. In this instance, heat of high temperature is generated in the space due to increased resistance, thereby fusing the contacts.

In this instance, the contacts are kept closed without being open due to the fusion. Here, a function that the handle is restored to an ON position without being located at an OFF position refers to the main contact function.

For a molded case circuit breaker, the main contact location function can be made up for in a manner that the lower end point 70*a* of the main spring 70 is set to be located more forward (ahead) upon designing a product. However, when the molded case circuit breaker is located at the ON position, there is a limit on an angle between a weight axis of the main spring 70 and the lower link 30, which does not allow the lower end point to be located more forward.

The related art molded case circuit breaker performs its original function under an ideal condition. However, actually-produced products frequently faces a case of failing to perform the original function due to friction between components and a movement, which is caused by accumulated assembly tolerance among products.

Also, an angle between the rotation point 10*a* of the lever 10 and the lower end point 70*a* of the main spring 70 serves as an important factor of deciding a position of the lever 10. When the angle between both of the points is reduced, a restoring force of the lever 10 toward the ON position by virtue of the main spring 70 is lowered.

Therefore, when a small angle is formed between both of the points for the related art molded case circuit breaker, a problem that the lever 10 fails to return to the ON position has been caused. In addition, as the rotation point of the main spring 70 is located more backward than the rotation point of the lever 10 due to the movement caused by the accumulated assembly tolerance, the lever 10 is moved to the OFF position without returning to the ON position, and the molded case circuit breaker externally outputs an OFF state. Accordingly, the movable contactor 50 and the fixed contactor 60 which are in a contact state due to being fused to each other but they are externally recognized as being in the OFF state in which they are separated from each other. This may bring about an electric shock accident to an operator who has recognized that the molded case circuit breaker is in the OFF state.

SUMMARY OF THE INVENTION

Therefore, to solve the aforementioned problems, an aspect of the detailed description is to provide a molded case circuit breaker, capable of preventing an accident by allowing a state of the molded case circuit breaker to be recognized from the exterior without an error, in a manner of preventing a handle from being moved to an OFF position when a fixed contactor and a movable contactor are fused to each other.

To achieve these and other advantages and in accordance with the purpose of this specification, as embodied and broadly described herein, there is provided a molded case circuit breaker including a shaft configured to rotatably support a movable contactor to be brought into contact with or separated from a fixed contactor, a lower link rotatably connected to one side of the shaft, a lever connected to another side of the lower link, and an upper link rotatably connected to the lower link at an inner side of the lever, wherein the upper link is provided with an anti-rotation member, and the lever is provided with a locking member formed at the inner side thereof. The locking member may be locked at the anti-rotation member when the lever is rotated to an OFF position in a fused state between the fixed contactor and the movable contactor, so as to prevent the rotation of the lever to the OFF position.

Also, the anti-rotation member may include a supporting plate extending from the upper link in a lateral direction of the upper link, and an inclined portion downwardly inclined from one side of the supporting plate by a predetermined angle and locked at the locking member when the lever is rotated to the OFF position.

The locking member may be formed in a shape of a pin or a bar.

The inclined portion may be provided with a locking member accommodating recess formed at an upper surface thereof, such that the locking member is accommodated in the locking member accommodating recess when the lever is rotated to the OFF position, so as to prevent the rotation of the lever to the OFF position.

The locking member may be provided with an insertable protrusion, and the inclined portion may be provided with an insertion recess formed at an upper surface of the inclined portion. Accordingly, the insertable protrusion may be inserted into the insertion recess to prevent the rotation of the lever to the OFF position when the lever is rotated to the OFF position in the fused state between the fixed contactor and the movable contactor.

The molded case circuit breaker may further include at least one rigidity-reinforcing plate provided at a connected portion between the upper link and the supporting plate.

In a molded case circuit breaker according to exemplary embodiments of the present invention, a locking member may be formed at an inner side of a lever and an anti-rotation member may be formed at an upper like. Accordingly, the locking member can be brought into contact with the anti-rotation member even though a handle is rotated to an OFF position even in a fused state between a fixed contactor and a movable contactor, thereby preventing a rotation of the handle to the OFF position.

Since the rotation of the handle to the OFF position is prevented, a lower end point of a main spring can always be located more forward than a rotation point of the lever, the lever can be restored to an ON position when a manipulation force is removed even though the lever is moved from the ON position to the OFF position.

Since the rotation of the handle to the OFF position in the fused state between the fixed contactor and the movable contactor is prevented, a state of the molded case circuit breaker can be prevented from being wrongly recognized from the exterior. This may result in preventing an occurrence of an electric shock accident and the like to an operator, which is caused due to the operator recognizing the ON state as the OFF state while a fault current is applied.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a molded case circuit breaker in accordance with one exemplary embodiment of the present invention, with reference to the accompanying drawings.

Figure 1:
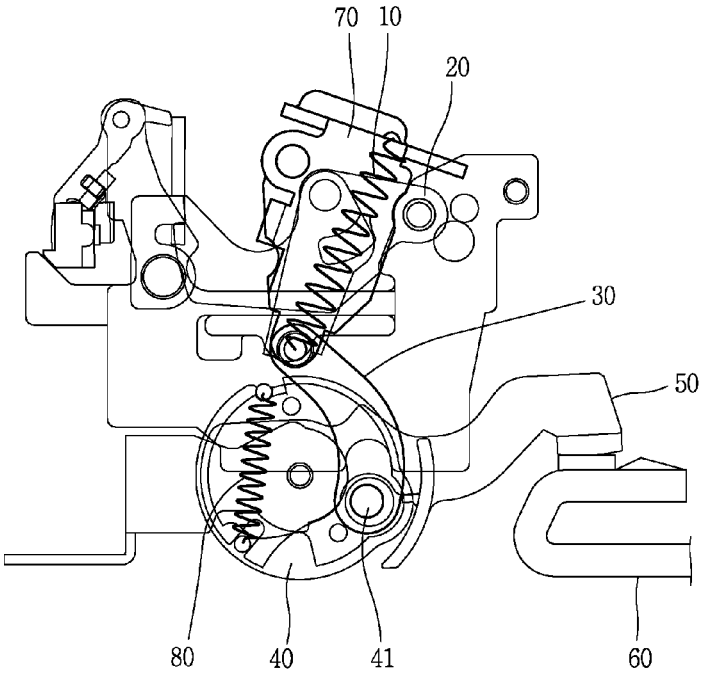
FIG. 1 RELATED ART
FIG. 1 is a schematic sectional view illustrating a configuration of the related art molded case circuit breaker.
Figure 2:
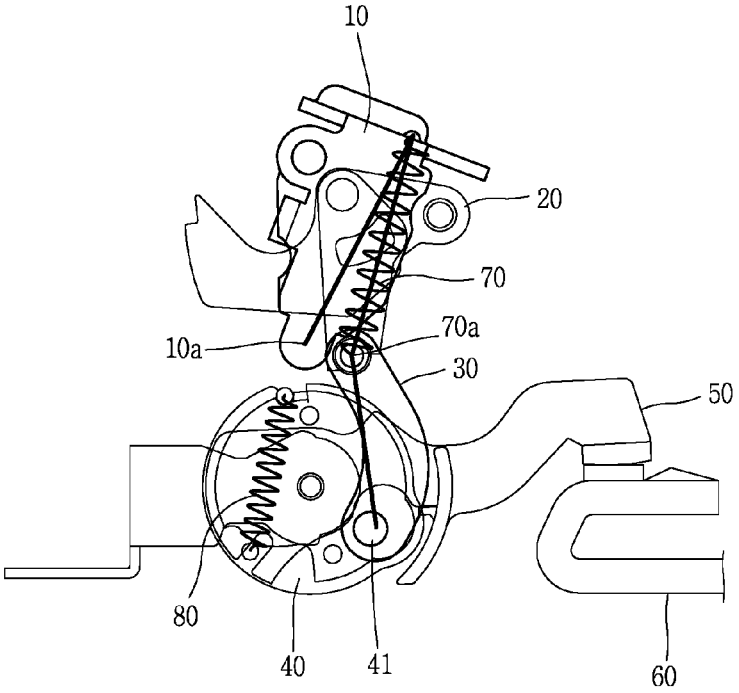
FIG. 2 RELATED ART
FIG. 2 is a schematic sectional view illustrated in a state when the related art molded case circuit breaker is located at an ON position.
Figure 3:
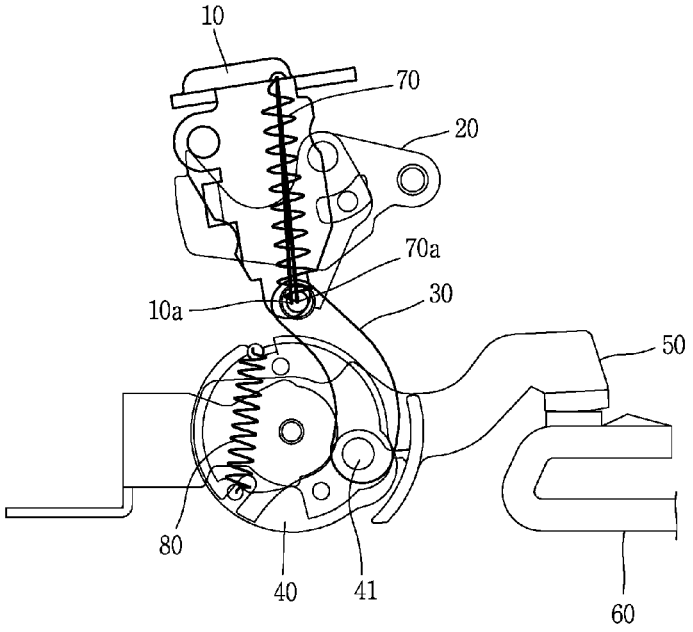
FIG. 3 RELATED ART
FIG. 3 is a schematic view illustrating a state where a lever is rotated to an OFF position while the related art molded case circuit breaker is in a fused state.
Figure 4:
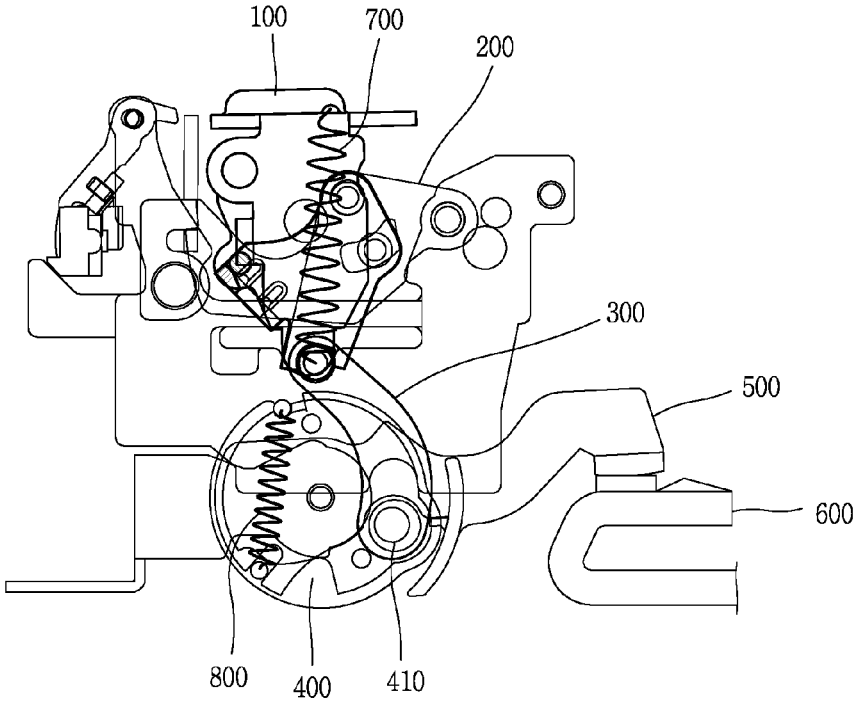
FIG. 4 is a schematic configuration view of a switching mechanism of a molded case circuit breaker in accordance with a first exemplary embodiment of the present invention.
Figure 5:
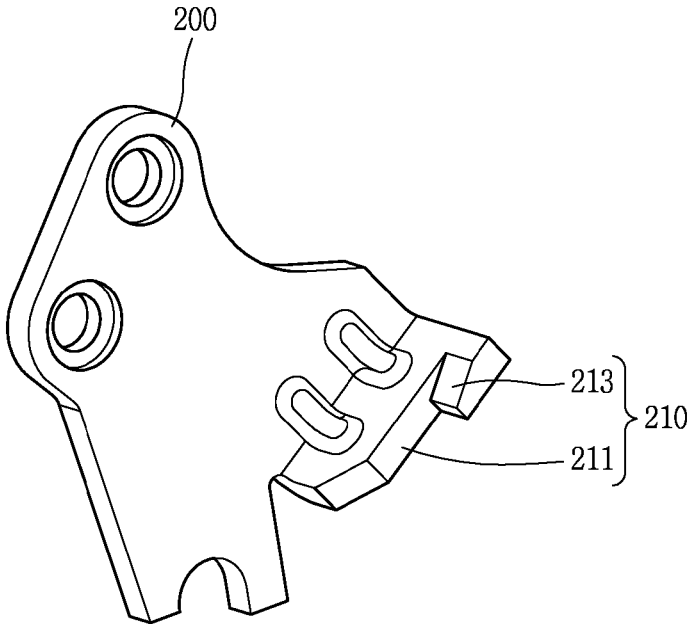
FIG. 5 is a schematic perspective view of an anti-rotation member formed at an upper link used for a molded case circuit breaker in accordance with the first exemplary embodiment of the present invention.
Figure 6:
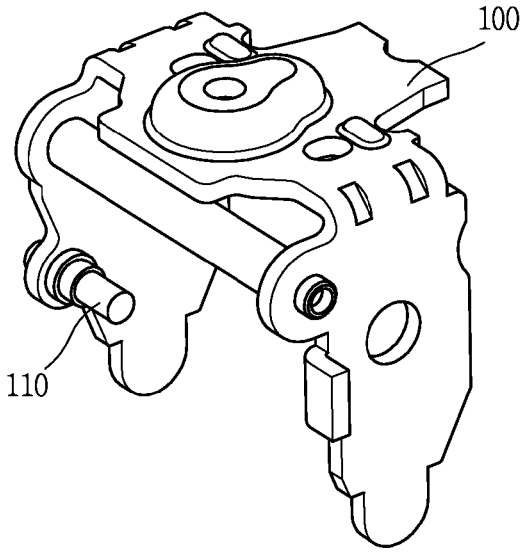
FIG. 6 is a perspective view illustrating a lever used for a molded case circuit breaker in accordance with the first exemplary embodiment of the present invention.
Figure 7:
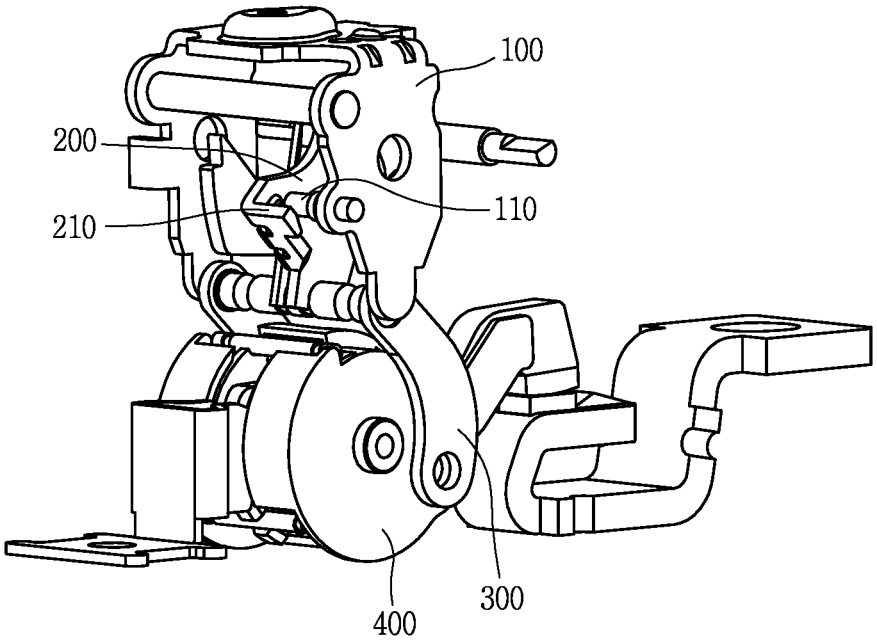
FIG. 7 is a schematic perspective view illustrating a closely-adhered state between a locking member formed at the lever and the anti-rotation member formed at the upper link while the molded cased circuit breaker is rotated to an OFF state, in accordance with the first exemplary embodiment of the present invention.
Figure 8:
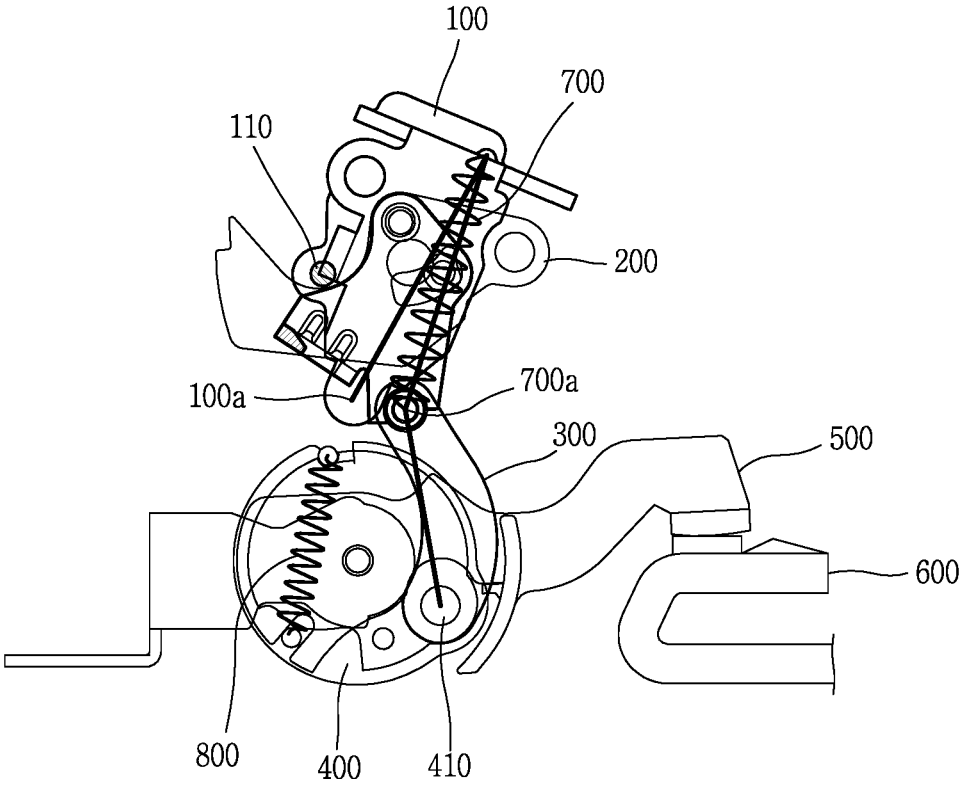
FIG. 8 is a sectional view illustrating a separated state between the locking member formed at the lever and the anti-rotation portion formed at the upper link when the molded case circuit breaker is located at an ON position, in accordance with the first exemplary embodiment of the present invention.
Figure 9:
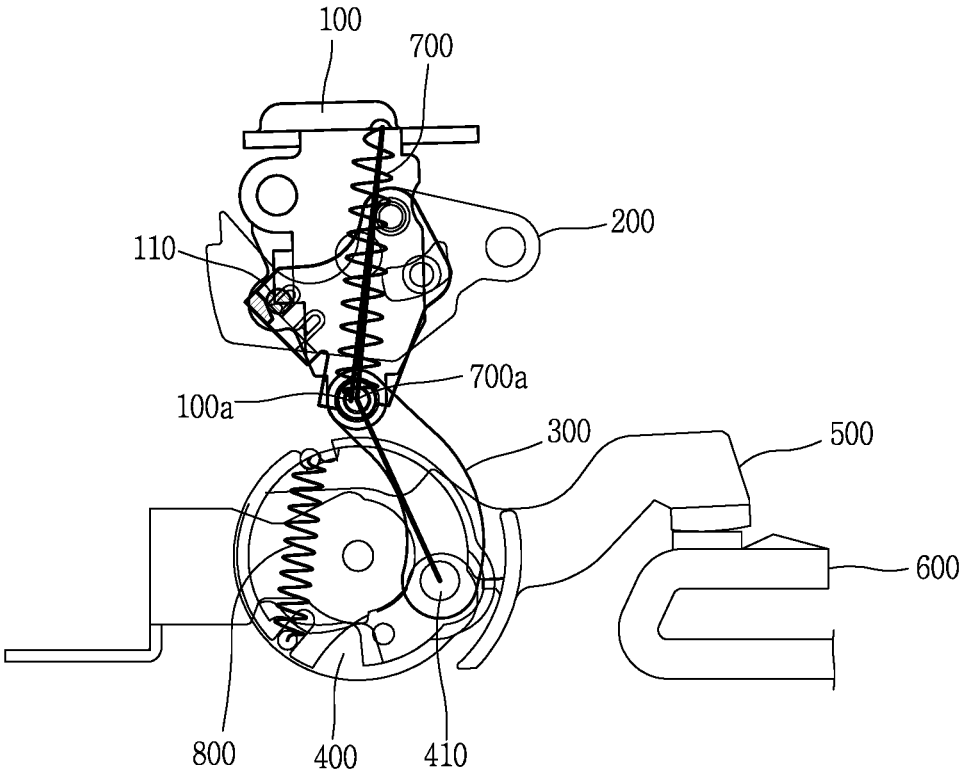
FIG. 9 is a sectional view illustrating a closely-adhered state between the locking member formed at the lever and the anti-rotation portion formed at the upper link while the molded cased circuit breaker is rotated to the OFF state, in accordance with the first exemplary embodiment of the present invention.
Figure 10:
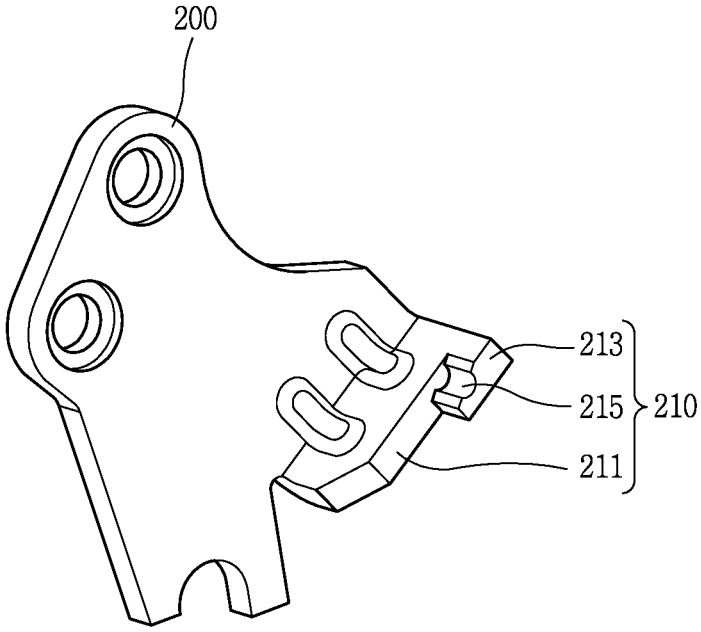
FIG. 10 is a perspective view of an upper link in accordance with a second exemplary embodiment of the present invention.
Figure 11:
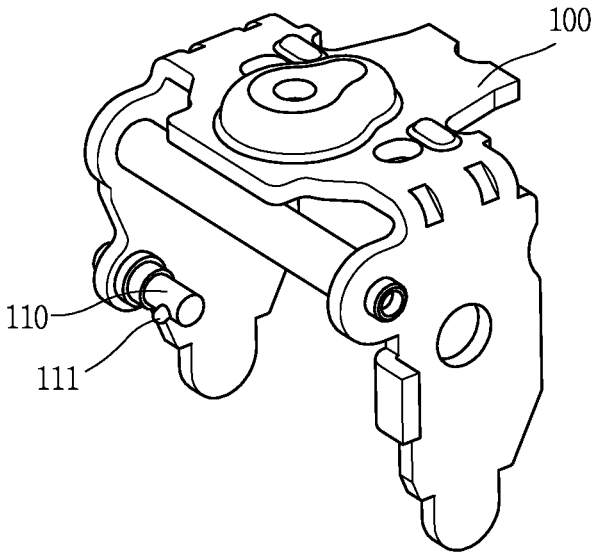
FIG. 11 is a perspective view of a lever in accordance with a third exemplary embodiment of the present invention.
Figure 12:
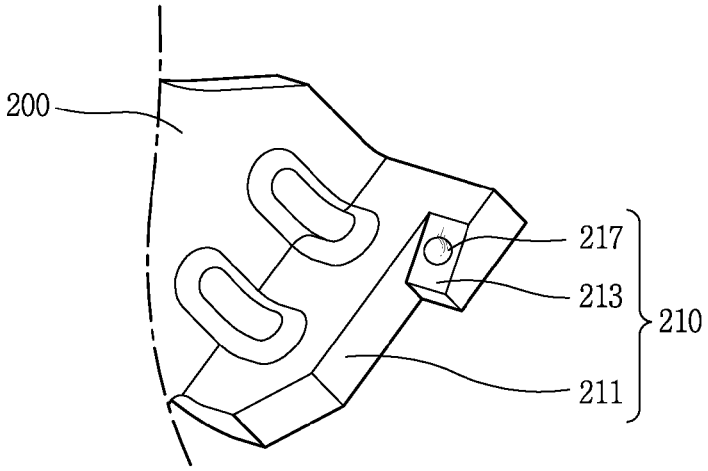
FIG. 12 is a perspective view of an upper link in accordance with the third exemplary embodiment of the present invention.
Figure 13:
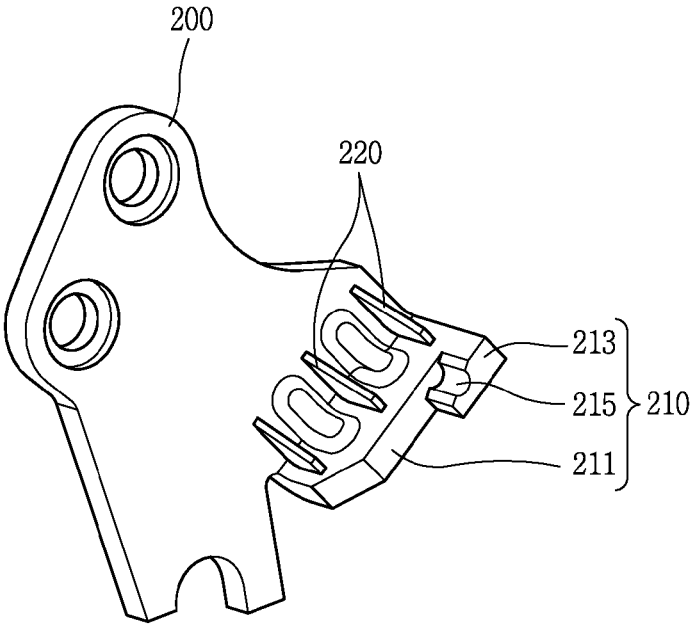
FIG. 13 is a perspective view of an upper link in accordance with a fourth exemplary embodiment of the present invention.

FIG. 4 is a schematic configuration view of a switching mechanism of a molded case circuit breaker in accordance with a first exemplary embodiment of the present invention, FIG. 5 is a schematic perspective view of an anti-rotation member formed at an upper link used for a molded case circuit breaker in accordance with the first exemplary embodiment of the present invention, FIG. 6 is a perspective view illustrating a lever used for a molded case circuit breaker in accordance with the first exemplary embodiment of the present invention, FIG. 7 is a schematic perspective view illustrating a closely-adhered state between a locking member formed at the lever and the anti-rotation member formed at the upper link while the molded cased circuit breaker is rotated to an OFF state, in accordance with the first exemplary embodiment of the present invention, and FIG. 8 is a sectional view illustrating a separated state between the locking member formed at the lever and the anti-rotation portion formed at the upper link when the molded case circuit breaker is located at an ON position, in accordance with the first exemplary embodiment of the present invention;

Also, FIG. 9 is a sectional view illustrating a closely-adhered state between the locking member formed at the lever and the anti-rotation portion formed at the upper link while the molded cased circuit breaker is rotated to the OFF state, in accordance with the first exemplary embodiment of the present invention, FIG. 10 is a perspective view of an upper link in accordance with a second exemplary embodiment of the present invention, FIG. 11 is a perspective view of a lever in accordance with a third exemplary embodiment of the present invention, FIG. 12 is a perspective view of an upper link in accordance with the third exemplary embodiment of the present invention, and FIG. 13 is a perspective view of an upper link in accordance with a fourth exemplary embodiment of the present invention.

As illustrated in FIG. 4, a molded case circuit breaker according to the present invention may include a handle (not illustrated), a lever 100, a main spring 700, an upper link 200, a lower link 300, a shaft 400, a fixed contactor 600 and a movable contactor 500.

The handle may be located at an upper portion of the molded case circuit breaker. In response to a user's manipulation for the handle, the shaft 400 may be rotated to an ON position where the movable contactor 500 comes in contact with the fixed contactor 600 or an OFF position where the movable contactor 50 is separated from the fixed contactor 600.

The lever 100 may be coupled to a lower portion of the handle so as to support both sides of the handle at the lower side of the handle. The lever 100 may provide a rotation supporting point of the handle.

The main spring 700 may be implemented as a coil spring or the like. An upper end of the main spring 700 may be connected to the lever 100 and provide an elastic force to the lower link 300, in response to a rotation of the lever 100, using elastic energy. Accordingly, the shaft 400 connected to the lower link 300 may be rotated in a clockwise or counterclockwise direction, such that the movable contactor can be separated from or brought into contact with the fixed contactor 600.

Here, a lower end point of the main spring 700 may be configured not to be equal to (aligned with) a rotation point of the lever 100 in a horizontal direction, but to be located more forward than the rotation point of the lever 100. With the configuration, when the lever 100 is rotated from the ON position to the OFF position, the main spring 700 may apply an elastic force to the lever 100 such that the lever 100 returns toward the ON position in a fused state between the movable contactor 500 and the fixed contactor 600.

The upper link 200 may be located at an inner side of the lever 100, and have an upper end connected to the lever 100 and a lower end rotatably connected to the lower link 300.

The lower link 300 may have an upper end rotatably connected to the upper link 200 and a lower end rotatably connected to the shaft 400 via a shaft pin 410. The lower link 300 may then receive the elastic force from the main spring 700 to rotate the shaft 400 in a clockwise or counterclockwise direction, thereby allowing the movable contactor 500 to be separated from or brought into contact with the fixed contactor 600.

Here, when the movable contactor 500 and the fixed contactor 600 are brought into contact with each other, contact pressure may be adjusted by a contact spring 800.

The shaft 400 may be rotatably connected with the movable contactor 500. The shaft 400 may be rotated by the elastic force of the main spring 700 transferred through the lower link 300. Responsive to this, the connected movable contactor 500 may be rotated to be separated from or brought into contact with the fixed contactor 600.

Meanwhile, as illustrated in FIG. 5, the upper link 200 may further be provided with an anti-rotation member 210 configured to prevent the lever 100 from being moved from the ON position to the OFF position while the movable contactor 500 and the fixed contactor 600 are fused to each other.

The anti-rotation member 210 may include a supporting plate 211 extending in a bent manner from the upper link 200 in a lateral direction of the upper link 200, and an inclined portion 213.

The supporting plate 211 may be formed in a shape of a plate. The supporting plate 211 may be bent from the side surface of the upper link 200 and protrude toward a locking member 110.

The inclined portion 213 may be formed at one side of the supporting plate 211 and inclined downwardly by a predetermined angle. When the lever 100 is moved to the OFF position, the inclined portion 213 may be locked at the locking member 110 so as to prevent the lever 100 from being moved to the OFF position. Accordingly, when a manipulation force is removed in a manner that a lower end point 700*a* of the main spring 700 is always located more forward than a rotation point 100*a* of the lever 100, the lever 100 may return to the ON position.

As illustrated in FIG. 6, the lever 100 may further be provided therein with the locking member 110 at which the anti-rotation member 210 is locked (stopped).

Here, the locking member 110 may be formed in a shape of a pin or bar, but may not be limited to the shape. The locking member 110 may be formed in various shapes to prevent the lever 100 from being rotated to the OFF position.

Therefore, when the lever 100 is located at the ON position, the anti-rotation member 210 is located with being spaced apart from the locking member 110 by a predetermined length. On the other hand, when the lever 100 is moved from the ON state into the OFF state, as illustrated in FIG. 7, the anti-rotation member 210 may be locked at the locking member 110, thereby preventing the movement of the lever 100 to the OFF position.

Meanwhile, as illustrated in FIG. 10, a molded case circuit breaker according to a second exemplary embodiment disclosed herein has the same configuration as that of the first exemplary embodiment, except for a locking member accommodating recess 215 further formed at the inclined portion 213.

Accordingly, when the lever 100 is moved to the OFF position in the fused state between the movable contactor 500 and the fixed contactor 600, the locking member 110 is closely adhered to the anti-rotation member 210 in a state that the locking member 110 is inserted in the locking member accommodating recess 215. This may prevent the lever 100 from being moved to the OFF position, and also prevent abrasion of a closely-adhered surface due to friction between the locking member 110 and the anti-rotation member 210.

As illustrated in FIGS. 11 and 12, a molded case circuit breaker according to a third exemplary embodiment disclosed herein has the same configuration as that of the first exemplary embodiment, except for those components, such as an insertable protrusion 111 further formed at the locking member 110, and an insertion recess 217 further formed at the anti-rotation member 210.

With the configuration, when the lever 100 is moved to the OFF position, the insertable protrusion 111 is inserted into the insertion recess 217 and accordingly the locking member 210 locks the anti-rotation member 210, so as to prevent the movement of the lever 100 toward the OFF position. Also, the locking member 110 and the anti-rotation member 210 may be fixed in a closely-adhered state so as to prevent abrasion of a closely-adhered surface therebetween, which is caused due to the movement of the lever 100 in the closely-adhered state.

As illustrated in FIG. 13, a molded case circuit breaker according to a fourth exemplary embodiment disclosed herein has the same configured as that of the first exemplary embodiment, except for a plurality of rigidity-reinforcing plates 220 further provided at a connected portion between the supporting plate 211 and the upper link 200.

Therefore, when the locking member 110 is closely adhered to the inclined portion 213, the connected portion between the supporting plate 211 and the upper link 200 may be affected by an impact and thereby be easily damaged. However, the plurality of rigidity-reinforcing plates 220 may further be provided to prevent the connected portion between the supporting plate 211 and the upper link 200 from being easily damaged.

Hereinafter, description will be given in detail of a process of preventing the lever 100 from being moved to the OFF position while the fixed contactor 600 and the movable contactor 500 are fused to each other in the molded case circuit breaker according to the present invention, with reference to FIGS. 8 and 9.

First, when the handle is moved to the ON position by a user's manipulation, the lever 100 connected to both sides of the handle is cooperatively rotated to the ON position. In response to the rotation of the lever 100, an elastic force of the main spring 700 connected to the lever 100 is transferred to the shaft 400 through the lower link 300. The shaft 400 is then rotated in a clockwise direction and accordingly the movable contactor 500 connected to the shaft 400 is brought into contact with the fixed contactor 500.

Afterwards, when the handle is moved to the OFF position while a contact portion between the movable contactor 500 and the fixed contactor 600 is fused, the lever 100 connected to the both sides of the handle is cooperatively moved to the OFF position. The elastic force of the main spring 700 is applied to the shaft 400 through the lower link 300. The shaft 400 is then rotated in a counterclockwise direction and accordingly the movable contactor 500 is rotated upward to be separated from the fixed contactor 600.

Here, because of the fused state between the movable contactor 50 and the fixed contactor 600, the shaft 400 is in an unrotatable state. Accordingly, the connected lower link 300 and upper link 200 are kept locked without being rotated.

Therefore, when only the lever 100 is rotated to the OFF position in response to the rotation of the handle, the locking member 110 formed at the lever 100 is locked at the anti-rotation member 210. This may prevent the movement of the lever 100 to the OFF position in the fused state between the fixed contactor 600 and the movable contactor 500. Accordingly, the lower end point 700*a* of the main spring 700 may always be located more forward than the rotation point 100*a* of the lever 100. Therefore, even though the lever 100 is rotated to the OFF position, when the manipulation force applied to the handle is removed, the lever 100 may be moved back to the ON position.

Also, as the lever 100 is moved back to the ON position, the ON or OFF state of the molded case circuit breaker can be recognized from the exterior without an error. This may result in effectively preventing an occurrence of an electric shock accident of an operator or the like, which may happen during a task, caused due to erroneously recognizing the ON state as the OFF state.

Meanwhile, in a non-fused state between the fixed contactor 600 and the movable contactor 500, when the lever 100 is rotated to the OFF position, the lower link 300 is also rotated by being pulled in a counterclockwise direction and simultaneously the connected upper link 200 may be rotated. Accordingly, the anti-rotation member 210 formed at the upper link 300 and the locking member 110 may not be brought into contact with each other, and thus the lever 100 may be normally moved to the OFF position.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all to changes and modifications that fall within the metes and bounds of the claims, or equivalents of such metes and bounds are therefore intended to be embraced by the appended claims.

What is claimed is:

1. A molded case circuit breaker comprising a shaft configured to rotatably support a movable contactor that is brought into contact with or separated from a fixed contactor, a lower link rotatably connected to a side of the shaft, a lever connected to a side of the lower link, and an upper link rotatably connected to the lower link at an inner side of the lever, wherein the upper link comprises an anti-rotation member, wherein the lever comprises a locking member formed in a shape of a in or a bar at the inner side, wherein the locking member is secured by the anti-rotation member when the lever is rotated toward an OFF position and the fixed contactor contacts the movable contactor such that rotation of the lever to the OFF position is prevented, wherein the anti-rotation member comprises:

a supporting plate extending from the upper link in a lateral direction of the upper link; and a portion downwardly inclined from one side of the supporting plate at a predetermined angle and secured by the locking member by coming in contact with the locking member when the lever is rotated toward the OFF position, wherein the locking member comprises an insertable protrusion, wherein an upper surface of the downwardly inclined portion comprises an insertion recess, wherein the insertable protrusion is inserted into the insertion recess such that rotation of the lever to the OFF position is prevented when the lever is rotated toward the OFF position, and wherein at least one rigidity-reinforcing plate is provided at a connected portion between the upper link and the supporting plate.

* * * * *